US005338121A

United States Patent [19]

Kobayashi et al.

[11] Patent Number: 5,338,121

[45] Date of Patent: Aug. 16, 1994

[54] SHUTTLE APPARATUS FOR PRINTER

[75] Inventors: Atsuhisa Kobayashi, Hyogo; Haruhiko Tokunaga; Hitoshi Moriyama, both of Kanagawa, all of Japan

[73] Assignee: Fujitsu Limited, Kawasaki, Japan

[21] Appl. No.: 88,270

[22] Filed: Jul. 7, 1993

[30] Foreign Application Priority Data

Jul. 24, 1992 [JP] Japan ..... 4-198301
Jul. 24, 1992 [JP] Japan ..... 4-198302

[51] Int. Cl.[5] ..... B41J 19/00

[52] U.S. Cl. ..... 400/322; 101/93.04; 310/12; 318/135

[58] Field of Search ..... 400/322, 324, 124, 122; 101/93.04, 93.05; 318/687, 135; 310/12

[56] References Cited

U.S. PATENT DOCUMENTS

| | | | |
|---|---|---|---|
| 3,941,051 | 3/1976 | Barrus et al. . | |
| 4,044,668 | 8/1977 | Barrus et al. | 101/93.04 |
| 4,149,808 | 4/1979 | Matthias | 400/322 |
| 4,151,447 | 4/1979 | von der Heide et al. | 318/135 |
| 4,180,766 | 12/1979 | Matula | 101/93.04 |
| 4,359,289 | 11/1982 | Burrus et al. | 401/93.04 |
| 4,543,884 | 10/1985 | Kikuchi et al. | 101/93.04 |
| 4,637,307 | 1/1987 | Miller | 101/93.04 |
| 4,757,760 | 7/1988 | Nihara et al. | 101/93.05 |
| 4,764,040 | 8/1988 | Whitaker | 101/93.04 |
| 4,819,556 | 4/1989 | Abe et al. | 101/93.04 |
| 4,834,565 | 5/1989 | Takekoshi et al. . | |
| 4,839,543 | 6/1989 | Beakley et al. | 310/12 |
| 4,852,480 | 8/1989 | Kunita et al. | 101/93.05 |
| 4,870,306 | 9/1989 | Petersen | 310/12 |
| 4,921,365 | 5/1990 | Sanders, Jr. et al. | 400/322 |
| 4,941,405 | 7/1990 | Helms | 101/93.04 |
| 5,129,746 | 7/1992 | Epstein | 101/93.04 |

FOREIGN PATENT DOCUMENTS

| | | | |
|---|---|---|---|
| 0027358 | 3/1981 | Japan | 101/93.04 |
| 0163673 | 9/1983 | Japan | 61/93.04 |
| 0169257 | 7/1986 | Japan | 101/93.04 |
| 0016159 | 1/1987 | Japan | 101/93.04 |
| 0094349 | 4/1987 | Japan | 101/93.04 |

*Primary Examiner*—Eugene H. Eickholt

[57] ABSTRACT

A shuttle apparatus for a printer having a print shuttle unit driven to reciprocate. The print shuttle unit includes a print shuttle provided with a print head and movable along a guide device. A row of permanent magnets are attached to the print shuttle, and a row of electromagnetic coils are secured to a stationary member so as to face the permanent magnets across a gap. The coils and the permanent magnets constitute a linear motor for reciprocating the print shuttle unit along the guide device. A balance shuttle unit having approximately the same weight as that of the print shuttle unit is disposed so that the center of gravity of the balance shuttle unit travels on a line approximately the same as the line of travel of the center of gravity of the print shuttle unit. The balance shuttle unit is driven to reciprocate in linked relation to the print shuttle unit in parallel but reverse in direction to the print shuttle unit.

34 Claims, 10 Drawing Sheets

SHUTTLE APPARATUS FOR PRINTER

BACKGROUND OF THE INVENTION

1. Field of the Invention

The present invention relates to a shuttle apparatus which reciprocates to effect printing in a line printer or other similar printer.

2. Description of the Related Art

In line printers or other similar printers, a print shuttle unit equipped with a print head needs to reciprocate at high speed, and a linear motor is used as a device for driving the print shuttle unit.

Therefore, a row of electromagnetic coils are attached to a print shuttle unit movable along a stay shaft with a print head mounted thereon, and a row of permanent magnets are secured to a base frame so as to face the electromagnetic coils, thereby forming a linear motor.

In operation, as current is passed through the electromagnetic coils attached to the print shuttle unit, thrust is induced in the electromagnetic coils according to the Fieming's left-hand rule. By properly controlling the current supplied to the electromagnetic coils, the direction of the thrust is changed, thus causing the print shuttle unit to reciprocate.

However, since the electromagnetic coils are mounted on the print shuttle unit, if the volumetric capacity of the electromagnetic coils is increased in order to raise the output of the linear motor, the print shuttle unit becomes correspondingly heavier, resulting in an increase in the load. Accordingly, the speed of the reciprocating motion cannot be raised so high as expected.

Further, an assembly of lead wires for connecting the electromagnetic coils to a power supply is secured at one end thereof to the base frame, while the other end of the lead wire assembly reciprocates together with the print shuttle unit. It is therefore likely that the lead wires will be damaged and disconnected by the repeated reciprocating motion.

In addition, since the print shuttle unit is considerably heavy in weight, the high-speed reciprocating motion thereof causes vibration of the whole printer.

To cope with this problem, a balance shuttle unit is generally employed. More specifically, a balance shuttle unit, which is formed with approximately the same weight as that of the print shuttle unit, is driven in linked relation to the reciprocating motion of the print shuttle unit so that these two shuttle units move parallel to each other in opposite directions, thereby canceling reaction force generated in the base frame of the printer by the reciprocating motion of the print shuttle unit. Thus, generation of vibration is suppressed.

However, if the print shuttle unit and the balance shuttle unit move parallel to each other in opposite directions, rotation moment is induced by the motions of the two shuttle units. As a result, rotation vibration is generated in the whole printer, causing the print quality to be degraded, for example, by undesired movement of printing paper.

SUMMARY OF THE INVENTION

An object of the present invention is to provide a shuttle apparatus for a printer, which enables the reciprocating motion of a print shuttle unit to be sped up with ease and which is free from the problem of disconnection of lead wires of electromagnetic coils and hence highly reliable.

Another object of the present invention is to provide a shuttle apparatus for a printer, which is designed so that vibration of the printer is eliminated by suppressing rotation moment induced by the motion of a reciprocating print shuttle unit and that of a balance shuttle unit, which moves in a direction reverse to the direction of the reciprocating motion of the print shuttle unit, thereby enabling superior print quality to be obtained.

Other objects and advantages of the present invention will become apparent from the following detailed description of illustrated embodiments of the invention.

According to the present invention, there is provided a shuttle apparatus for a printer having a print shuttle provided with a print head and movable along a guide device. The shuttle apparatus includes a row of permanent magnets attached to the print shuttle, and a row of electromagnetic coils secured to a stationary member so as to face the permanent magnets across a gap, the electromagnetic coils constituting in combination with the permanent magnets a linear motor for driving the print shuttle to reciprocate along the guide device.

In addition, there is provided a shuttle apparatus for a printer having a print shuttle unit provided with a print head and driven to perform reciprocating motion. The shuttle apparatus includes a balance shuttle unit having approximately the same weight as that of the print shuttle unit and disposed so that the center of gravity of the balance shuttle unit travels on a line approximately the same as the line of travel of the center of gravity of the print shuttle unit, and a device for driving the balance shuttle unit to reciprocate in linked relation to the reciprocating motion of the print shuttle unit in parallel but reverse in direction to the print shuttle unit.

In addition, there is provided a shuttle apparatus for a printer having a print shuttle unit provided with a print head and driven to perform reciprocating motion. The shuttle apparatus includes a balance shuttle unit having approximately the same weight as that of the print shuttle unit and driven to reciprocate in linked relation to the reciprocating motion of the print shuttle unit in parallel but reverse in direction to the print shuttle unit, and a base frame for supporting both the print shuttle unit and the balance shuttle unit. A torque generating device is connected to the base frame at the position of the axis of rotation moment induced by the motions of the print shuttle unit and the balance shuttle unit to generate torque approximately equal in magnitude but opposite in direction to the rotation moment.

In addition, there is provided a shuttle apparatus for a printer having a print shuttle unit provided with a print head and driven to perform reciprocating motion. The shuttle apparatus includes a balance shuttle unit having approximately the same weight as that of the print shuttle unit and driven to reciprocate in linked relation to the reciprocating motion of the print shuttle unit in parallel but reverse in direction to the print shuttle unit, and a base frame for supporting both the print shuttle unit and balance shuttle unit. The shuttle apparatus further includes a counterweight exerting moment of inertia equivalent to or larger than rotation moment induced by the reciprocating motions of the print shuttle unit and the balance shuttle unit. The counterweight is attached to the base frame at the position of the axis of the rotation moment.

In addition, there is provided a shuttle apparatus for a printer having a print shuttle unit provided with a print head and driven to perform reciprocating motion. The shuttle apparatus includes a balance shuttle unit having approximately the same weight as that of the print shuttle unit and driven to reciprocate in linked relation to the reciprocating motion of the print shuttle unit in parallel but reverse in direction to the print shuttle unit, and a base frame for supporting both the print shuttle unit and the balance shuttle unit. Further, a vibration absorbing member is interposed between the base frame and a casing.

BRIEF DESCRIPTION OF THE DRAWINGS

The present invention may be more fully understood from the description of preferred embodiments of the invention set forth below, together with the accompanying drawings, in which.

DESCRIPTION OF THE PREFERRED EMBODIMENTS

Embodiments of the present invention will be described below with reference to the accompanying drawings.

Figure 1:
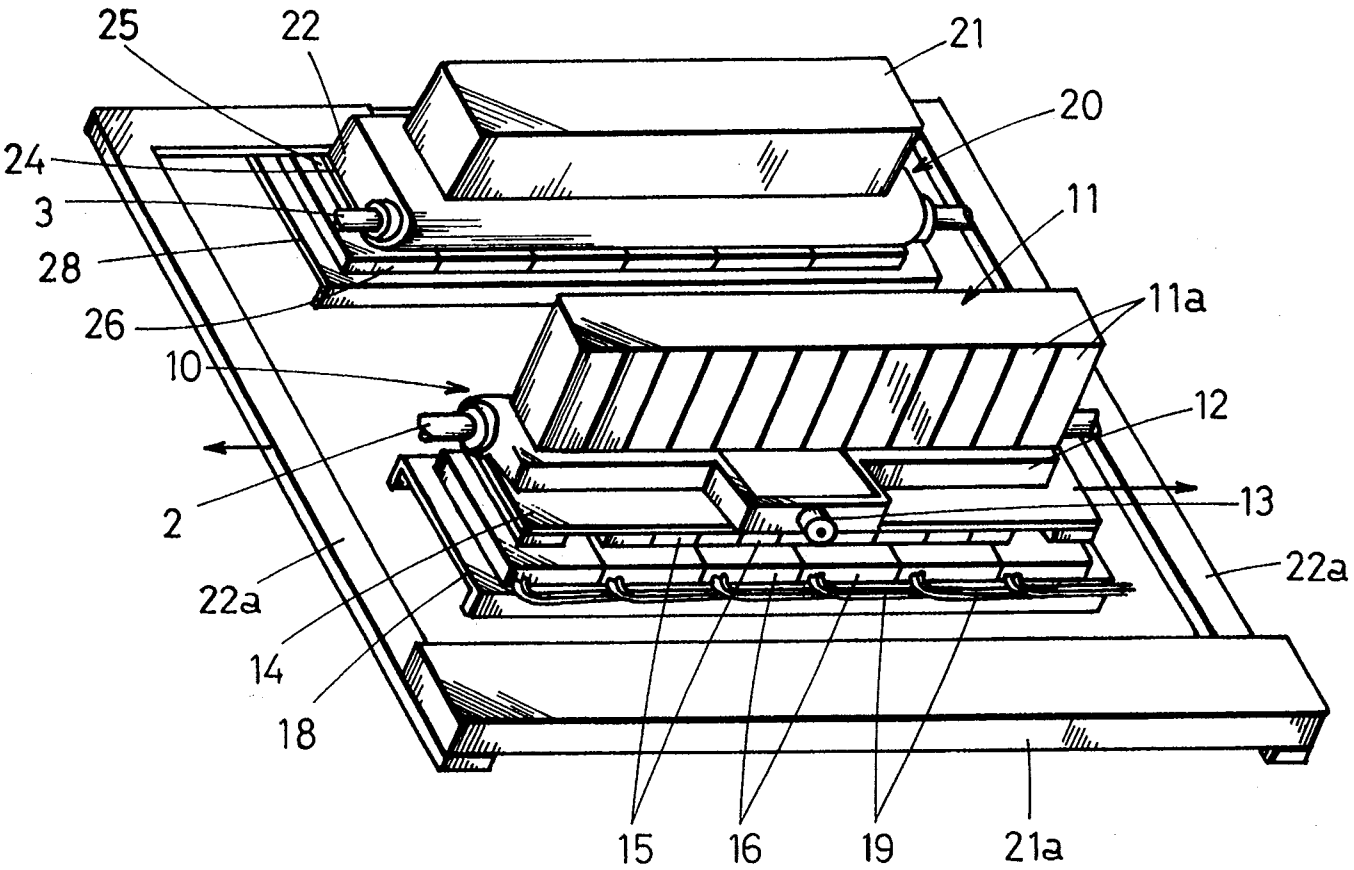
FIG. 1 is a perspective view of a first embodiment of the present invention, showing a print shuttle unit and a balance shuttle unit.
Figure 2:
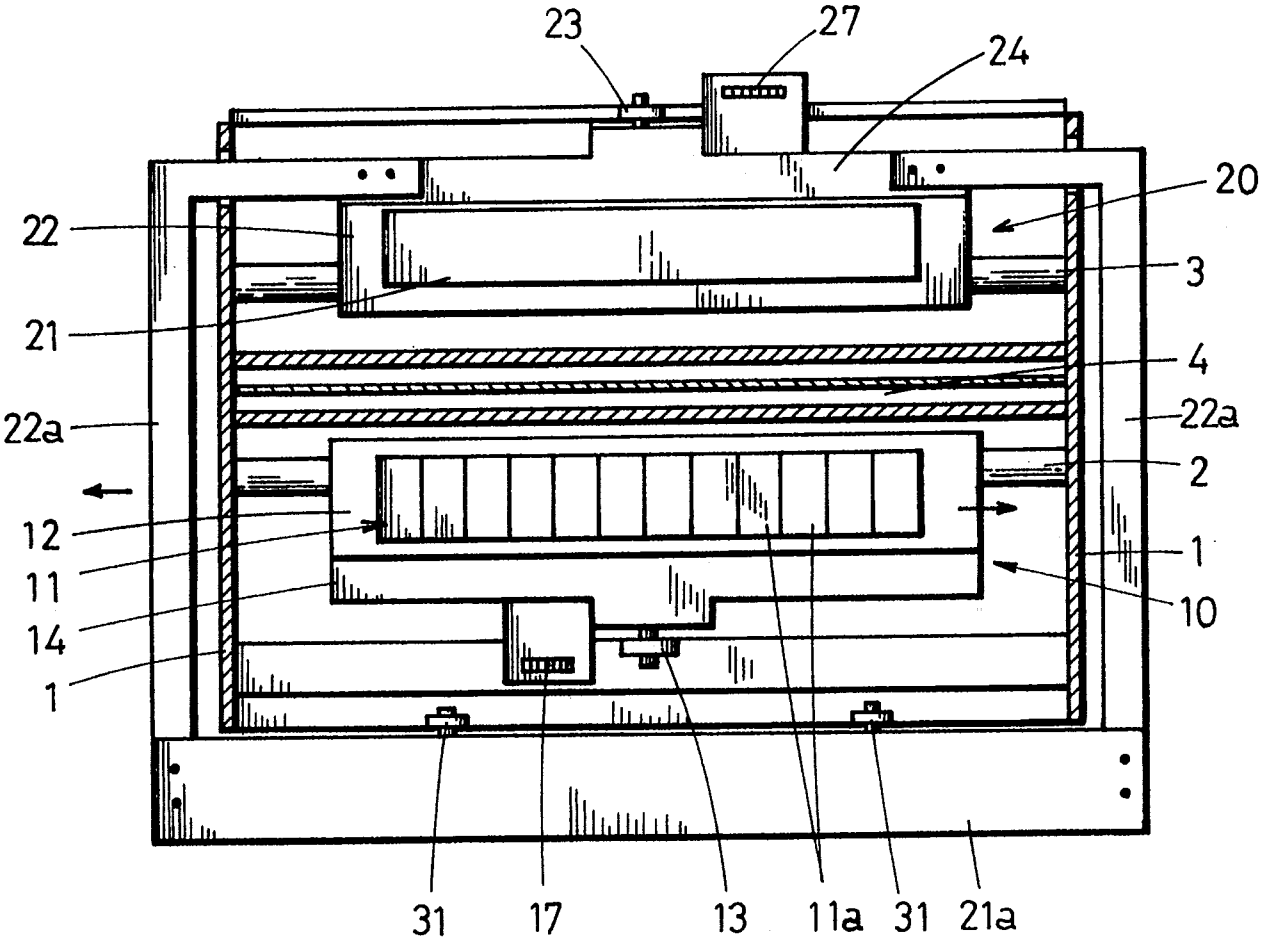
FIG. 2 is a plan view of the first embodiment of the present invention, showing the print shuttle unit and the balance shuttle unit.
Figure 3:
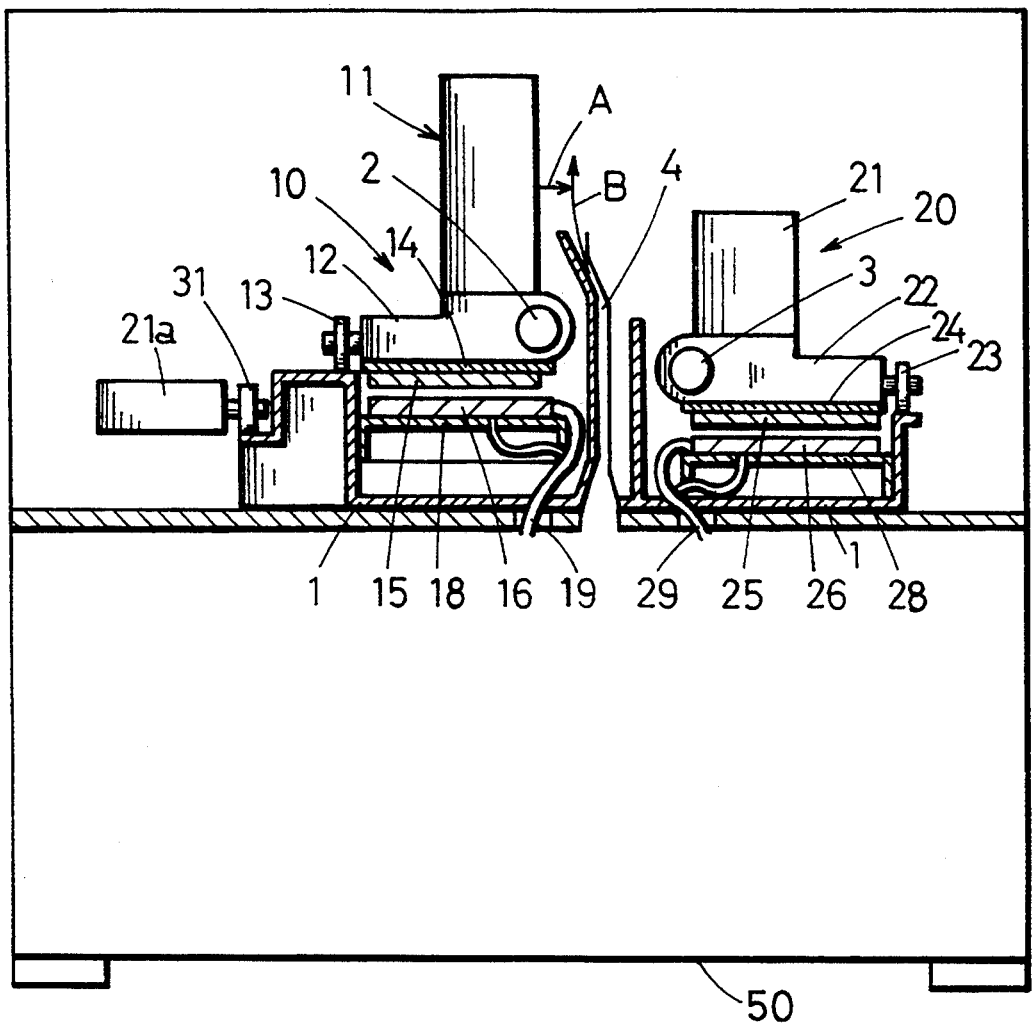
FIG. 3 is a sectional side view of the first embodiment of the present invention, showing the print shuttle unit and the balance shuttle unit.

FIGS. 1 to 3 show in combination a first embodiment in which the present invention is applied to a line printer. FIG. 1 is a perspective view of an essential part of the line printer which includes a print shuttle unit and a balance shuttle unit. FIGS. 2 and 3 are a plan view and a sectional side view of the same part of the line printer.

A base frame 1 is secured to a casing 50. A pair of parallel stay shafts 2 and 3 extend horizontally and are each secured at both ends thereof to the base frame 1. It should be noted that in FIG. 1 illustration of the casing 50 and the base frame 1 is omitted, and in FIG. 2 illustration of the casing 50 is omitted.

A print shuttle 12 is slidably fitted on the first stay shaft 2, which is disposed in the central portion of the base frame 1. The print shuttle 12 is equipped with a print head 11 comprising a row of a multiplicity of print pins. The print shuttle 12 is supported by the first stay shaft 2 and a roller 13 capable of traveling on the base frame 1.

The print head 11 is of the electromagnetic release type, for example. The print head 11 comprises a row of 12 (for example) print head assemblies 11*a* of 24-pin type arranged horizontally. Each print head assembly 11*a* is formed from 4 sets of 6 print elements which are respectively arranged in front upper, front lower, rear upper and rear lower stages in such a manner that the two sets of print elements in the front and rear upper stages are symmetric with respect to those in the front and rear lower stages. The print elements perform printing in units of dots by print pins.

When the print head 11 is driven, the distal ends of the print pins project in the direction of the arrow A, shown in FIG. 3, thereby striking printing paper, which is fed in the direction of the arrow B through a paper feed passage 4, through an ink ribbon (not shown). Thus, impact dot printing is carried out.

A yoke 14, which is a planar iron plate, is attached to the bottom of the print shuttle 12. A row of a multiplicity of rectangular plate-shaped permanent magnets 15 are disposed on the lower surface of the yoke 14 in a direction parallel to the axis of the first stay shaft 2. The permanent magnets 15 are each magnetized in the direction of the thickness thereof. That is, each permanent magnet 15 has two magnetic poles at the upper and lower end faces thereof.

The permanent magnets 15 are formed by using rare-earth magnets, which have a strong magnetic property, for example, samarium-cobalt magnets. Accordingly, the permanent magnets 15 are thin and light in weight in comparison to ferrite magnets or others (e.g., the thickness and weight are each 1/5 of that in the case of the latter).

Figure 4:
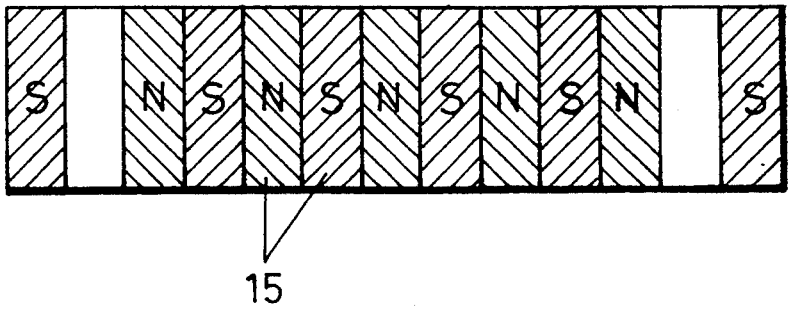
FIG. 4 is a plan view of permanent magnets in the first embodiment of the present invent ion.

Each permanent magnet 15 has a slightly larger width than that of each print head assembly 11. As shown in FIG. 4, a series of 11 permanent magnets 15 are disposed so that N and S poles alternate with each other. Among the 11 permanent magnets 15, a row of 9 permanent magnets are disposed contiguously, and one permanent magnet is disposed at each end of the row of permanent magnets with a spacing provided between the same and the end of the row.

Thus, the print shuttle 12, and the print head 11, the yoke 14 and the permanent magnets 15, which are attached to the print shuttle 12, form a print shuttle unit 10 which is movable along the first stay shaft 2.

A row of electromagnetic coils 16 are secured to a coil base 18, which is formed from an iron plate secured to the base frame 1, so that the electromagnetic coils 16 face the permanent magnets 15 of the print shuttle unit 10 across a slight gap.

Thus, the permanent magnets 15 and the electromagnetic coils 16 form a linear motor (first linear motor) for driving the print shuttle unit 10. Lead wires 19 are used to feed electric power to the electromagnetic coils 16.

Figure 5:
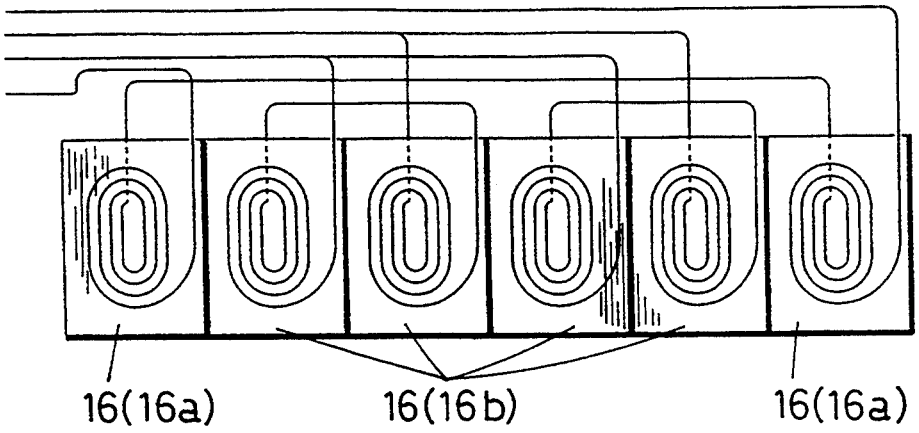
FIG. 5 is a plan view of electromagnetic coils in the first embodiment of the present invention.

Each electromagnetic coil 16 is spirally coiled so as to have a width double that of each permanent magnet 15. As schematically shown in FIG. 5, a row of 6 electromagnetic coils 16 are disposed contiguously. It should be noted that the outer edges of each pair of adjacent electromagnetic coils 16 are in contact with each other, although they are schematically shown as being separate from each other in FIG. 5.

Among the 6 electromagnetic coils 16, two electromagnetic coils 16*a* which are disposed at both ends, respectively, of the row of electromagnetic coils 16 are used to reverse the operation of the first linear motor. These electromagnetic coils 16*a* are connected in series to the same lead wires. On the other hand, the four electromagnetic coils 16*b*, which are disposed in between the electromagnetic coils 16*a*, are used to drive the first linear motor at a constant speed. These electromagnetic coils 16*b* are connected in series to lead wires in pairs, which are different from those for the end electromagnetic coils 16*a*.

In the first linear motor, arranged as described above, as current is passed through the electromagnetic coils 16, which are placed in the magnetic fields produced by the permanent magnets 15, thrust is induced in the electromagnetic coils 16 on the basis of the Fieming's left-hand rule.

However, since the electromagnetic coils 16 are immovably fixed to the base frame 1, the reaction force to the thrust acts on the permanent magnets 15. As a result, the print shuttle unit 10 moves along the first stay shaft 2.

By properly controlling the current supplied to the electromagnetic coils 16, the print shuttle unit 10 can be rectilinearly reciprocated at high speed along the first stay shaft 2.

In addition, a position detecting sensor 17 is provided, as shown in FIG. 2. The position detecting sensor 17 comprises slits formed in the yoke 14 of the print shuttle unit 10, and a transmissive photosensor that is attached to the base frame 1. In FIGS. 1 and 3, illustration of the position detecting sensor 17 is omitted.

A balance shuttle 22, which is formed in the same way as the print shuttle 12, is slidably fitted on the second stay shaft 3, which is disposed parallel to the first stay shaft 2.

A counterweight 21 is mounted on the balance shuttle 22, and a yoke 24 is attached to the bottom of the balance shuttle 22. A row of permanent magnets 25, which are similar to the permanent magnets 15 of the print shuttle unit 10, are attached to the lower surface of the yoke 24.

A roller 23 is rotatably attached to the balance shuttle 22 so that the balance shuttle 22 travels on the base frame 1. The balance shuttle 22 is supported by the roller 23 and the second stay shaft 3.

The balance shuttle 22 further has a pair of arms 22*a* which are connected thereto so as to project from both lateral ends, respectively, of the base frame 1. The arms 22*a* are bent to extend beyond the position of the print shuttle unit 10 as far as the other end of the base frame 1, and a counterweight unit 21*a* is attached to the distal ends of the arms 22*a*.

Thus, a balance shuttle unit 20 is formed from the balance shuttle 22 and the counterweight 21, the yoke 24, the permanent magnets 25 and the arms 22*a*, which are attached to the balance shuttle 22, together with the counterweight unit 21*a* attached to the distal ends of the arms 22*a*.

The constituent elements of the balance shuttle unit 20 can move as one unit in parallel to the print shuttle unit 10. Rollers 31 are rotatably attached to the counterweight unit 21*a* so that the counterweight unit 21*a* travels on the base frame 1.

The balance shuttle unit 20 is formed so that the overall weight thereof is approximately equal to that of the print shuttle unit 10.

Figure 6:
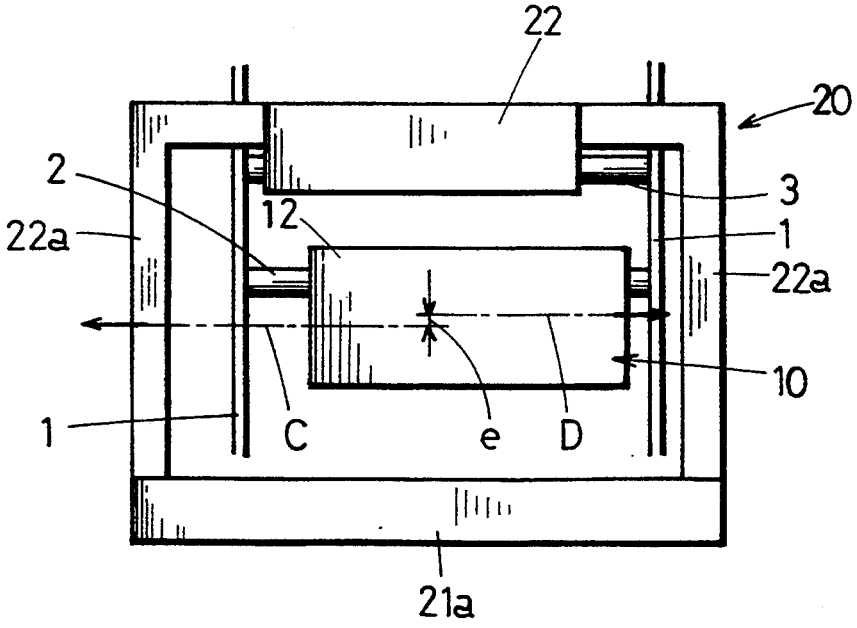
FIG. 6 is a schematic plan view of the first embodiment of the present invention, showing the print shuttle unit and the balance shuttle unit.

Distribution of weight in the balance shuttle unit 20 is made so that, as shown in FIG. 6, the line C of travel of the center of gravity of the whole balance shuttle unit 20 during the movement along the second stay shaft 3 is approximately coincident with the line D of travel of the center of gravity of the print shuttle unit 10 during the movement along the first stay shaft 2 ($e \approx 0$).

Referring back to FIGS. 1 to 3, a coil base 28 is secured to the base frame 1, and a row of electromagnetic coils 26, which are similar to the electromagnetic coils 16 shown in FIG. 5, are secured to the coil base 28 so as to face the row of permanent magnets 25 disposed on the balance shuttle 22 across a slight gap.

Thus, the permanent magnets 25 and the electromagnetic coils 26 form a linear motor (second linear motor) for driving the balance shuttle unit 20. Lead wires 29 are used to supply electric power to the electromagnetic coils 26.

By properly controlling the current passed through the electromagnetic coils 26, the balance shuttle unit 20 can be rectilinearly reciprocated at high speed along the second stay shaft 3.

Figure 7:
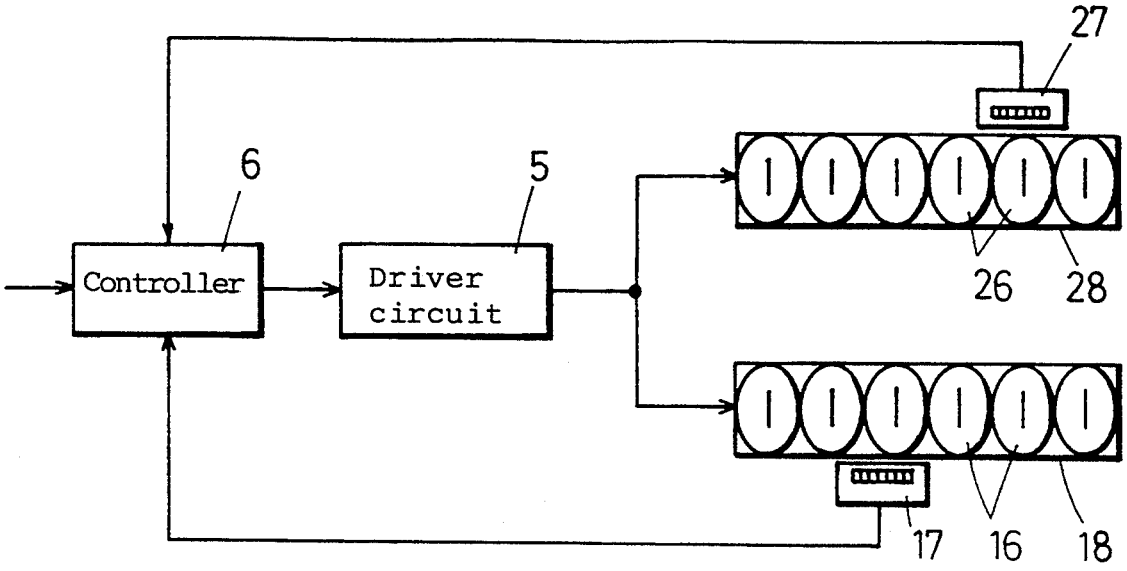
FIG. 7 shows schematically a circuit configuration of the first embodiment of the present invention.

FIG. 7 schematically shows a circuit configuration for the first and second linear motors. The electromagnetic coils 16 and 26 are supplied with the same driving current from a single driver circuit 5 so that the print shuttle unit 10 and the balance shuttle unit 20 move relative to each other in opposite directions at the same speed to perform high-speed reciprocating motion.

For this purpose, the print shuttle unit 10 and the balance shuttle unit 20 are arranged in reverse relation to each other in terms of either the polarities of the permanent magnets 15 and 25 or the winding direction of the electromagnetic coils 16 and 26.

A controller 6 for controlling the operation of the driver circuit 5 is fed with signals for reversing and constant-speed travel from the position detecting sensor 17 of the print shuttle unit 10 to effect feedback control for the reciprocating motion.

The controller 6 is further fed with a signal from a position detecting sensor 27 provided on the balance shuttle unit 20 to monitor for the occurrence of overrun or other trouble of the balance shuttle unit 20.

In the first embodiment of the printer shuttle apparatus, arranged as described above, the electromagnetic coils 16 and 26 of both the first and second linear motors are secured to the base frame 1, and the permanent magnets 15 and 25 are attached to the print shuttle 12 and the balance shuttle 22, respectively, which are movable members.

Accordingly, even if the volumetric capacities of the electromagnetic coils 16 and 26 are increased in order to increase the output of the linear motors, there is no increase in the weight of the movable members. Therefore, the reciprocating motion of the print shuttle unit 10 and that of the balance shuttle unit 20 can be sped up with ease.

Further, since the lead wires 19 and 29 for the electromagnetic coils 16 and 26 are not connected to the movable members, there is no likelihood of disconnection of the lead wires 19 and 29 by the repeated reciprocating motion.

Since the permanent magnets 15 and 25 can be made thin and light in weight by forming them using rare-earth magnets having a strong magnetic property, it is possible to reduce the overall weights of the shuttle units 10 and 20 and to narrow the gaps between the yokes 14 and 24 on the one hand and the coil bases 18 and 28 on the other so as to raise the magnetic flux density. Thus, it is possible to realize an increase in the output of the linear motors and also an increase in the speed thereof.

Although in this embodiment the present invention is applied to both the print shuttle unit 10 and the balance shuttle unit 20, the present invention may be applied to only the print shuttle unit 10 in a printer that is not provided with the balance shuttle unit 20.

In the printer shuttle apparatus of this embodiment, as the print shuttle unit 10 reciprocates along the first stay shaft 2, the balance shuttle unit 20, which is approximately equal in weight to the print shuttle unit 10, moves along the second stay shaft 3 in a direction reverse to the direction of travel of the print shuttle unit 10 at the same speed as that of the print shuttle unit 10 in linked relation to it.

Accordingly, reaction force that is induced in the base frame 1 by the reciprocating motion of the print shuttle unit 10 is canceled by the reciprocating motion of the balance shuttle unit 20.

In addition, during the reciprocating motion, the center of gravity of the balance shuttle unit 20 moves on a line approximately the same as the travel line of the center of gravity of the print shuttle unit 10. Accordingly, no rotation moment is induced by the reciprocating motions of the two shuttle units 10 and 20.

The balance shuttle unit 20 may be arranged such that the balance shuttle 22 and the counterweight unit 21*a* are connected by using ropes or belts in place of the arms 22*a* so that the counterweight unit 21*a* moves in the same direction and at the same speed as the balance shuttle 22.

Figure 8:
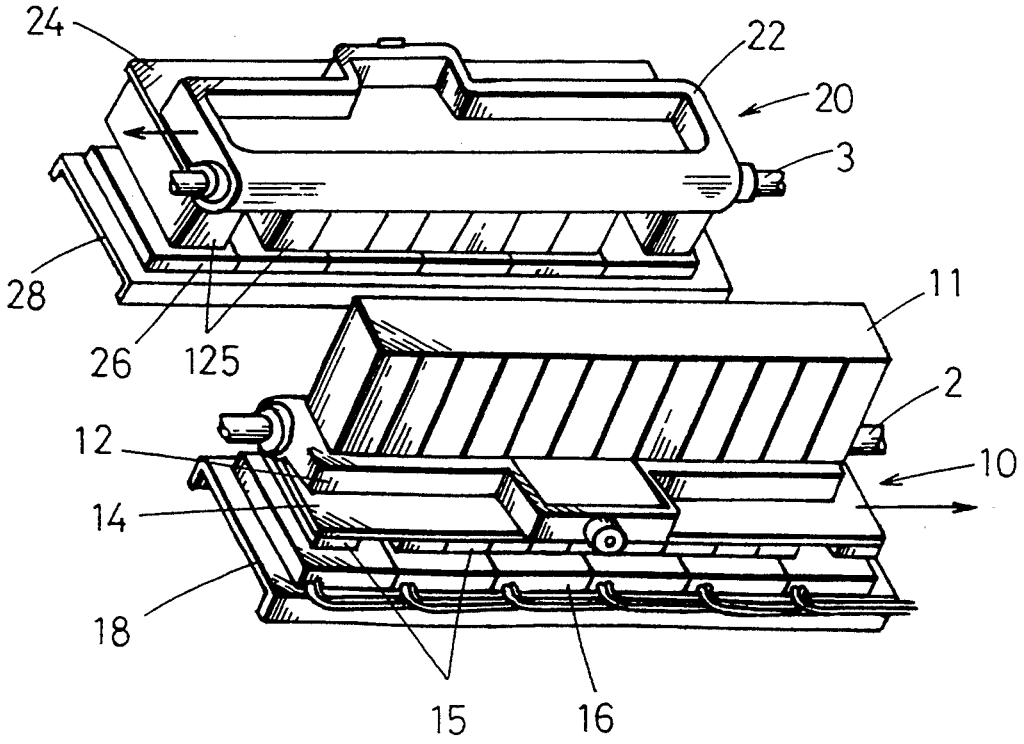
FIG. 8 is a perspective view of a second embodiment of the present invention.

FIG. 8 shows a second embodiment of the present invention, in which the balance shuttle unit 20 is provided with permanent magnets 125 of relatively low magnetic property comprising, for example, ferrite magnets, which show a magnetic property weaker than that of the permanent magnets 15 of the print shuttle unit 10, which are rare-earth magnets.

The permanent magnets 125 need a considerably large volumetric capacity in order to obtain the same magnetic flux density as that of rare-earth magnets. Accordingly, the weight thereof increases.

As a result, it becomes unnecessary to mount a counterweight on the balance shuttle 22, as shown in FIG. 8, or it is only necessary to mount a small counterweight thereon. Therefore, an efficient structure is realized. Further, since ferrite magnets are less costly than rare-earth magnets, the cost of the apparatus can be lowered.

Figure 9:
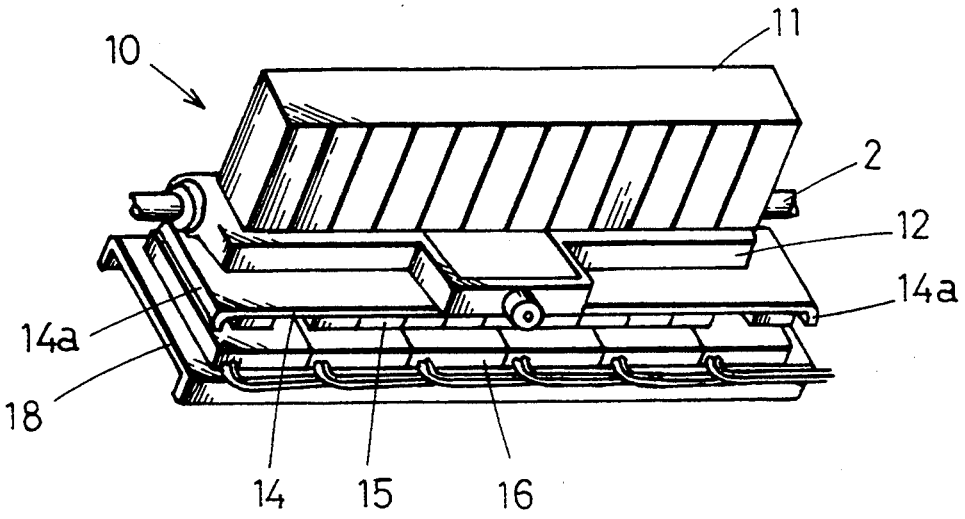
FIG. 9 is a perspective view of a third embodiment of the present invention.
Figure 10:
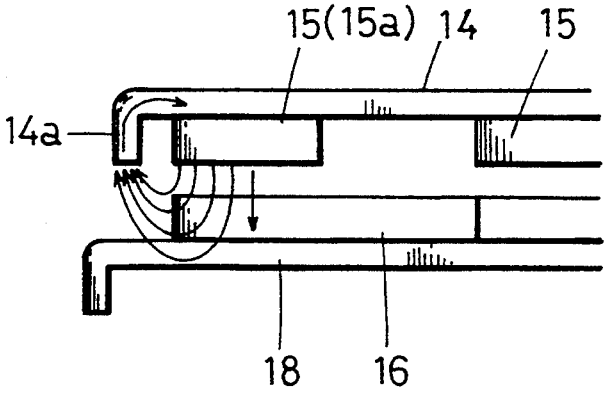
FIG. 10 is a fragmentary front view of the third embodiment of the present invention.

FIG. 9 shows a third embodiment of the present invention, in which both end portions 14*a* of the yoke 14, which is attached to the print shuttle 12, are bent so as to face the respective outer sides of the two end permanent magnets 15 across a slight gap.

By virtue of the above-described arrangement, magnetic flux that leaks sidewardly from the end permanent magnets 15*a* is effectively transmitted to the yoke 14 through the end portions 14*a* of the yoke 14 without leaking to the outside.

Accordingly, it is possible to eliminate such an adverse effect of leakage magnetic flux on the surroundings that the leakage magnetic flux is vibrated by the reciprocating motion of the print shuttle unit 10, causing fluctuations in the surrounding magnetic field, which would, for example, make the screens of various displays unstable.

Figure 11:
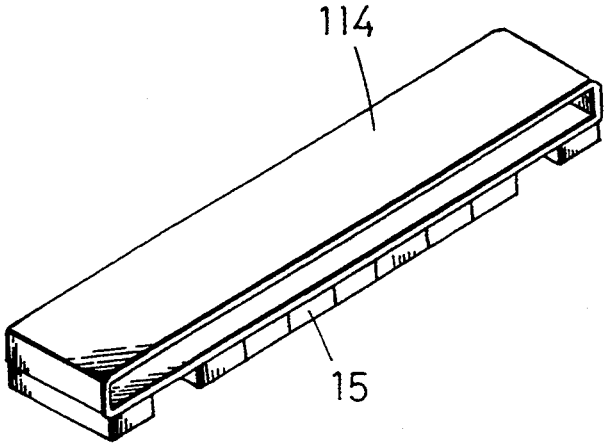
FIG. 11 is a fragmentary perspective view of a fourth embodiment of the present invention.
Figure 12:
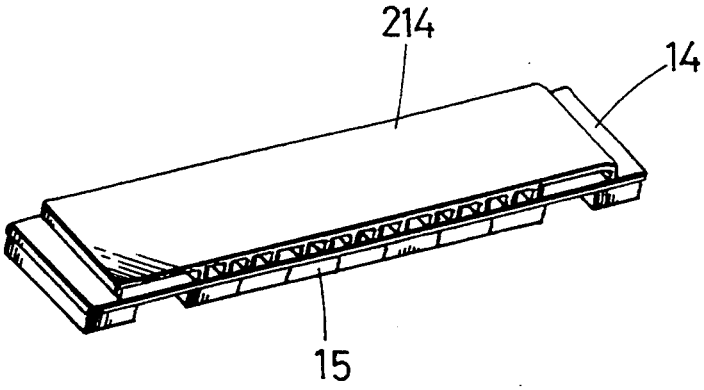
FIG. 12 is a fragmentary perspective view of a fifth embodiment of the present invention.

FIGS. 11 and 12 show fourth and fifth embodiments, respectively, of the present invention, in which a yoke that is provided on the print shuttle 12 for mounting the permanent magnets 15 has a structure which forms a closed magnetic circuit.

Even the flat plate-shaped yoke 14 as shown in the first embodiment can prevent magnetic flux from leaking from the reverse side of the yoke 14, that is, the side thereof which is reverse to the side where the permanent magnets 15 are attached, provided that the thickness of the yoke 14 can be sufficiently increased.

However, the thickness of the yoke 14 cannot always be increased satisfactorily because it is necessary to minimize the load on the linear motor. Further, it is impossible, in many cases, to eliminate completely leakage of magnetic flux from the reverse side of the yoke 14 due to holes provided in the yoke 14 for securing it to the print shuttle 12.

Accordingly, in the fourth embodiment shown in FIG. 11, a yoke 114, to which the permanent magnets 15 are attached, is formed in an annular structure so that a closed magnetic circuit is formed. In the fifth embodiment shown in FIG. 12, an auxiliary yoke 214 having a multiplicity of legs in the shape of the teeth of a comb is laid on the outer side of the flat plate-shaped yoke 14 having the permanent magnets 15 attached thereto, thereby obtaining a yoke structure which forms a closed magnetic circuit.

With such a structure, leakage magnetic flux, which may occur due to some reason, can be confined within the yoke so as not to leak out. Accordingly, no fluctuation is caused in the surrounding magnetic field.

Although in the third to fifth embodiments, shown in FIGS. 9 to 12, description has been made about the yoke of the print shuttle unit 10, it should be noted that if a balance shuttle unit is also provided, a structure similar to the above is preferably adopted for the yoke of the balance shuttle unit, as a matter of course.

Figure 13:
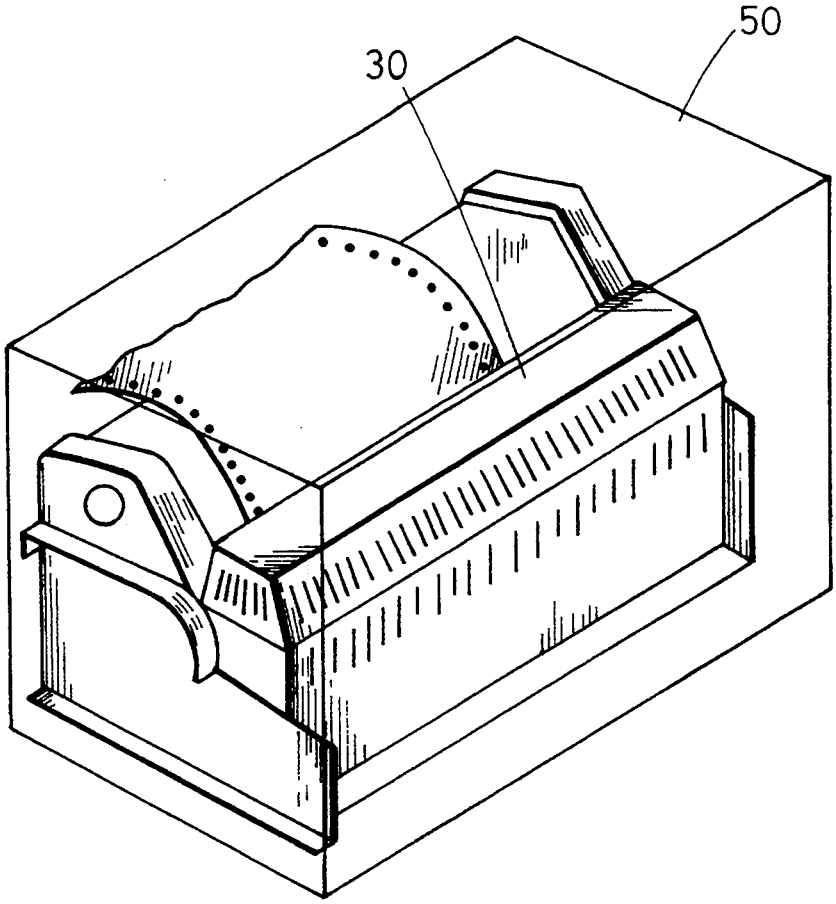
FIG. 13 is a perspective view of a sixth embodiment of the present invention.

FIG. 13 shows a sixth embodiment of the present invention, in which the whole print shuttle unit 10 is covered with a magnetic shield cover 30 formed of iron plate, for example. Reference numeral 50 denotes a printer casing.

In general, the printer equipment has various covers. Therefore, as long as the cover material is a magnetic material and the covers are not saturated with leakage magnetic flux, a sufficient magnetic shield effect can be obtained by connecting together as many covers as possible to construct a magnetic shield cover which forms a closed magnetic circuit.

In a case where the covers are formed from a plastic material or in a case where saturation of magnetic flux cannot be prevented by the covers alone and hence the magnetic shield effect is not perfect, it is necessary to form a closed magnetic circuit inside the covers by a magnetic shield cover 30 made of a magnetic material.

The above-described structure, in which magnetic flux is prevented from leaking out by the magnetic shield cover 30, can be constructed by using the covers of the printer, which are essential members therefor, and will not increase the load on the linear motor. Therefore, it is extremely efficient.

In a printer that is provided with the balance shuttle unit 20, it is preferable to cover also the balance shuttle unit 20 with a magnetic shield cover 30 which may be the same as or different from that for the print shuttle unit 10.

Figure 14:
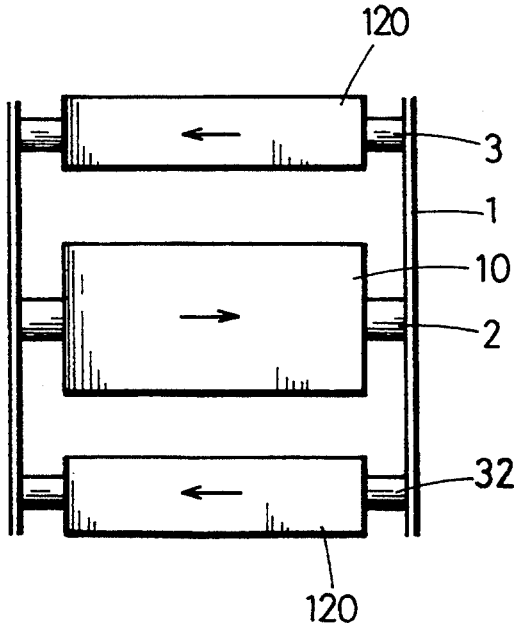
FIG. 14 is a schematic view of a seventh embodiment of the present invention.
Figure 15:
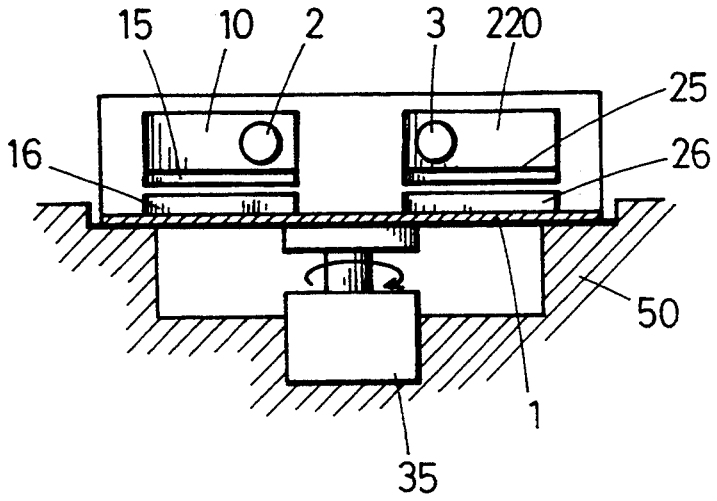
FIG. 15 is a schematic view of an eighth embodiment of the present invention.

FIG. 14 schematically shows a seventh embodiment of the present invention, in which a pair of balance shuttle units 120 are provided to face each other across the print shuttle unit 10, each balance shuttle unit 120 being the same as the balance shuttle unit 20 in the first embodiment except that it is not provided with the arms 22*a* and the counterweight unit 21*a*. Reference numeral 32 denotes a stay shaft.

In this case, the total weight of the two balance shuttle units 120 is made approximately equal to the weight of the print shuttle unit 10, and the two balance shuttle units 120 are disposed so that the travel line of the center of gravity of the balance shuttle units 120 is approximately coincident with the travel line of the center of gravity of the print shuttle unit 10. The two balance shuttle units 120 are driven to move in the same direction and at the same speed.

It should be noted that three or more balance shuttle units 120 may be provided. It is also possible to combine a plurality of balance shuttle units with a counterweight unit, for example, which is connected thereto through arms or the like.

FIG. 8 schematically shows an eighth embodiment of the present invention, which differs from the first embodiment in that a balance shuttle unit 220 is not provided with the arms 22*a* and the counterweight unit 21*a*, which is connected to the distal ends of the arms 22*a* in the first embodiment, and weight of the balance shuttle unit 220 is made approximately equal to the weight of the print shuttle unit 10. Accordingly, rotation moment is induced by the reciprocating motion of the print shuttle unit 10 and that of the balance shuttle unit 220.

Therefore, in this embodiment a motor 35, which generates torque that is approximately equal in magnitude but opposite in direction to the rotation moment induced by the motions of the two shuttle units 10 and 220, is disposed in between the casing 50 and the base frame 1 with the axis thereof made coincident with that of the rotation moment induced by the two shuttle units 10 and 220.

With the above-described arrangement, the rotation moment induced by the two shuttle units 10 and 220 is canceled by the torque generated by the motor 35. Accordingly, no rotational vibration is generated. It should be noted that the motor 35 may be replaced by a rotary solenoid, for example.

Figure 16:
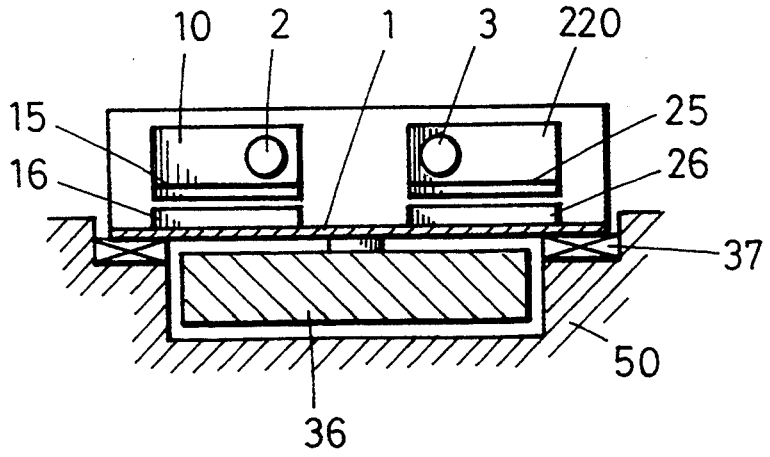
FIG. 16 is a schematic view of a ninth embodiment of the present invention.

FIG. 16 schematically shows a ninth embodiment of the present invention, in which the balance shuttle unit 220 is arranged in the same way as in the above-described eighth embodiment, and the base frame 1 is provided to be rotatable relative to the casing 50 in coaxial relation to the rotation moment.

In addition, an extremely heavy counterweight 36 is attached to the base frame 1. The counterweight 36 exerts moment of inertia which is equivalent to or larger than the rotation moment induced by the two shuttle units 10 and 220 and has the center of gravity lying on the axis of the rotation moment. Reference numeral 37 denotes bearings.

With the above-described arrangement, it is possible to minimize the effect of the rotation moment, which is induced by the two shuttle units 10 and 220, on the base frame 1 and to thereby suppress generation of rotational vibration.

Figure 17:
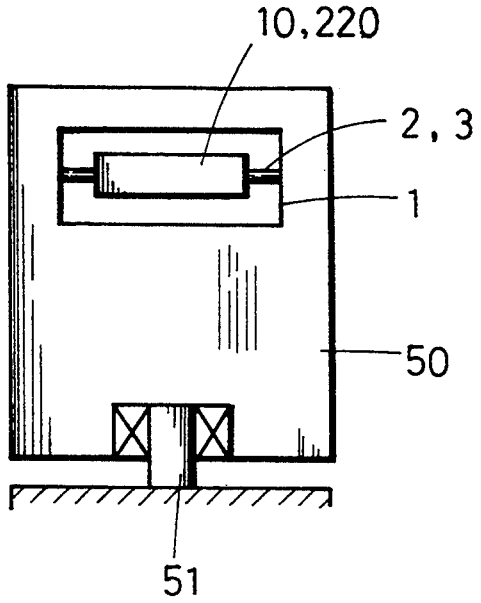
FIG. 17 is a schematic view of a tenth embodiment of the present invention.

FIG. 17 schematically shows a tenth embodiment of the present invention, in which the counterweight 36 in the ninth embodiment is formed by the casing 50.

In this embodiment, a fixed support 51 for rotatably supporting the casing 50 is disposed coaxially with the center of rotation of the two shuttle units 10 and 220 so that the rotation moment induced by the two shuttle units 10 and 220 is canceled by the moment of inertia of the casing 50.

In general, the moment of inertia of the casing 50 is sufficiently larger than the rotation moment induced by the two shuttle units 10 and 220, and the period of rotational vibration is sufficiently short. Therefore, there is no possibility that the casing 50 will rotate.

Figure 18:
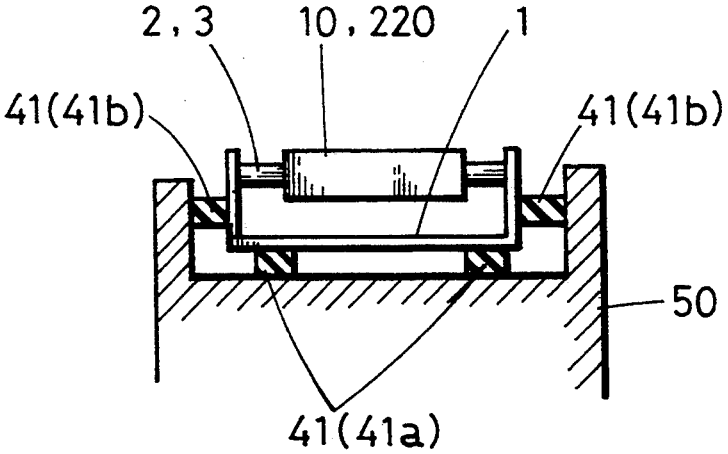
FIG. 18 is a schematic view of an eleventh embodiment of the present invention.

FIG. 18 shows an eleventh embodiment of the present invention, in which rubber vibration isolators 41 are installed to fasten the base frame 1 to the casing 50, thereby absorbing rotational vibration by the elasticity of the rubber vibration isolators 41. In addition, this embodiment also makes use of the fact that the period of rotational vibration is short. Thus, rotational vibration caused by the two shuttle units 10 and 220 is prevented from being transmitted to the casing 50.

In general, it is only necessary to provide rubber vibration isolators 41*a* for fastening the base frame 1 to the casing 50. However, if necessary, rubber vibration isolators 41*b* for regulating rotational vibration may also be mounted.

According to the present invention, permanent magnets are attached to a print shuttle, which is a movable member, and electromagnetic coils are provided on a fixed member. Therefore, even if the volumetric capacity of the electromagnetic coils is increased, there is no increase in the weight of the movable member. Accordingly, it is possible to increase the output of the linear motor according to need, and hence possible to readily speed up the reciprocating motion of the print shuttle.

Further, since no lead wires for the electromagnetic coils are connected to the movable member, there is no possibility of disconnection of the lead wires due to the repeated reciprocating motion. Thus, superior durability and reliability can be obtained.

If the permanent magnets are formed by using rare-earth magnets, which show a high magnetic property, it is possible to reduce the weight of the print shuttle unit and to increase the magnetic flux density. Thus, the reciprocating motion of the print shuttle unit can be readily sped up.

It is also possible to prevent magnetic flux from leaking out and to thereby avoid adverse effect on the surroundings by effectively bending both ends of the yoke, or forming the yoke in a closed magnetic circuit structure, or providing a magnetic shield cover. If permanent magnets of relatively low magnetic property are used as permanent magnets provided on the balance shuttle, it is possible to reduce the weight of the counterweight attached to the balance shuttle and to thereby attain an efficient structure.

Further, according to the present invention, the balance shuttle unit has approximately the same weight as that of the print shuttle unit and moves parallel to the print shuttle unit in a direction reverse to the direction of travel of the latter. Accordingly, reaction force that is generated in the base frame by the motion of the print shuttle unit is canceled by the balance shuttle unit. Thus, generation of vibration is suppressed. Further, since the center of gravity of the balance shuttle unit travels on approximately the same line as the travel line of the center of gravity of the print shuttle unit, no rotation moment is induced by the motions of the two shuttle units. As a result, vibration that is generated in the printer is minimized, and excellent print quality is obtained. Further, noise is also minimized.

If the base frame, which supports both the print shuttle unit and the balance shuttle unit, is given torque, which is approximately equal in magnitude but opposite in direction to rotation moment induced by the motions of the two shuttle units, by a torque generating device, the rotation moment induced by the two shuttle units is canceled by the torque.

Similarly, rotational vibration caused by the rotation moment of the two shuttle units is suppressed by providing a counterweight exerting moment of inertia which is equivalent to or larger than the rotation moment induced by the two shuttle units in place of the torque generating device. If vibration absorbing members are interposed between the base frame and the casing, rotational vibration caused by the rotation moment is prevented from being transmitted to the casing.

Thus, vibration that is generated in the printer is minimized, and excellent print quality is obtained.

While the invention has been described by reference to specific embodiments chosen for purposes of illustration, it should be apparent that numerous modifications could be made thereto by those skilled in the art without departing from the basic concept and scope of the invention.

We claim:

1. A shuttle apparatus for a printer having a print shuttle provided with a print head and movable along guide means, said shuttle apparatus comprising:

a row of first permanent magnets attached to said print shuttle;

a row of first electromagnetic coils secured to a stationary member so as to face said first permanent magnets across a gap, said first electromagnetic coils constituting in combination with said first permanent magnets a linear motor for driving said print shuttle to reciprocate along said guide means;

a balance shuttle which moves in linked relation to said print shuttle in parallel but reverse in direction to said print shuttle;

a row of second permanent magnets attached to said balance shuttle; and a row of second electromagnetic coils secured to a stationary member so as to face said second permanent magnets across a gap to constitute in combination with said second permanent magnets a second linear motor for driving said balance shuttle.

2. A shuttle apparatus for a printer according to claim 1, wherein said first permanent magnets are rare-earth magnets.

3. A shuttle apparatus for a printer according to claim 1, wherein said first permanent magnets attached to said print shuttle are rare-earth magnets, while said second permanent magnets attached to said balance shuttle are formed from a magnetic material weaker in magnetic property than said rare-earth magnets.

4. A shuttle apparatus for a printer according to claim 1, wherein said first permanent magnets are attached to a yoke provided on said print shuttle, said yoke forming a closed magnetic circuit.

5. A shuttle apparatus for a printer according to claim 4, wherein said yoke has an annular configuration.

6. A shuttle apparatus for a printer according to claim 4, wherein said yoke comprises a flat plate-shaped yoke and an auxiliary yoke having a multiplicity of legs in the shape of teeth of a comb, said auxiliary yoke being laid on top of said flat plate-shaped yoke.

7. A shuttle apparatus for a printer according to claim 1, further comprising a magnetic shield cover surrounding said print shuttle.

8. A shuttle apparatus for a printer according to claim 1, and further comprising a base frame for supporting both said print shuttle and balance shuttle.

9. A shuttle apparatus for a printer according to claim 8, and further comprising torque generating means connected to said base frame at a position of an axis of rotation moment induced by the motions of said print shuttle and said balance shuttle to generate torque approximately equal in magnitude but opposite in direction to said rotation moment.

10. A shuttle apparatus for a printer according to claim 8, and further comprising a counterweight exerting moment of inertia equivalent to or larger than rotation moment induced by the reciprocating motions of said print shuttle unit and balance shuttle unit, said counterweight being attached to said base frame at a position of an axis of said rotation moment.

11. A shuttle apparatus for a printer according to claim 1, wherein a single driver circuit is provided and said first and second electromagnetic coils are supplied with the same driving current from said single driver circuit.

12. A shuttle apparatus for a printer according to claim 11, and further comprising a controller coupled to said single driver circuit for controlling an operation thereof.

13. A shuttle apparatus for a printer according to claim 11, and further comprising a basing enclosing said frame with said print shuttle and said balance shuttle thereon, and a vibration adsorbing member interposed between said base frame and said casing.

14. A shuttle apparatus for a printer having a print shuttle provided with a print head and movable along guide means, said shuttle apparatus comprising:

a row of permanent magnets attached to said print shuttle; and a row of electromagnetic coils secured to a stationary member so as to face said permanent magnets across a gap, said electromagnetic coils constituting in combination with said permanent means a linear motor for driving said print shuttle to reciprocate along said guide means, wherein said permanent magnets are attached to a yoke provided on said print shuttle, said yoke having both end portions thereof bent so as to face respective outer sides of said permanent magnets at both ends of said row of permanent magnets across a gap.

15. A shuttle apparatus for a printer according to claim 14, wherein said permanent magnets are rare-earth magnets.

16. A shuttle apparatus for a printer according to claim 14, wherein said yoke comprises a flat plate-shaped yoke and an auxiliary yoke having a multiplicity of legs in the shape of teeth of a comb, said auxiliary yoke being laid on top of said flat plate-shaped yoke.

17. A shuttle apparatus for a printer according to claim 14, further comprising a magnetic shield cover surrounding said print shuttle.

18. A shuttle for a printer having a print shuttle unit provided with a print head and driven to perform reciprocating motion, said shuttle apparatus comprising:

a balance shuttle unit having approximately the same weight as that of said print shuttle unit and disposed so that the center of gravity of said balance shuttle unit travels on a line approximately the same as a line of travel of the center of gravity of said print shuttle unit; and means for driving said balance shuttle unit to reciprocate in linked relation to the reciprocating motion of said print shuttle unit in parallel but reverse in direction to said print shuttle unit, wherein said print shuttle unit is driven by a first linear motor, while said balance shuttle unit is driven by a second linear motor.

19. A shuttle apparatus for a printer according to claim 10, wherein said first and second linear motors are in reverse relation to each other in terms of either polarity of permanent magnets or winding direction of electromagnetic coils.

20. A shuttle apparatus for a printer according to claim 19, wherein the electromagnetic coils of said first and second linear motors are supplied with the same driving current from a single driver circuit.

21. A shuttle apparatus for a printer according to claim 18, and further comprising a base-frame for supporting both said print shuttle unit and balance shuttle unit.

22. A shuttle apparatus for a printer according to claim 21, and further comprising torque generating means connected to said base frame at a position of an axis of rotation moment induced by the motion of said print shuttle unit and balance shuttle unit to generate torque approximately equal in magnitude but opposite in direction to said rotation moment.

23. A shuttle apparatus for a printer according to claim 21, and further comprising a counterweight exerting moment of inertia equivalent to or larger than rotation moment induced by the reciprocating motions of said print shuttle unit and balance shuttle unit, said counterweight being attached to said base frame at a position of an axis of said rotation moment.

24. A shuttle apparatus for a printer according to claim 21, further comprising a casing enclosing said frame with said print shuttle unit and said balance shuttle unit, and a vibration adsorbing member interposed between said base frame and said casing.

25. A shuttle apparatus for a printer having a print shuttle unit provided with a print head and driven to perform reciprocating motion, said shuttle apparatus comprising:

a balance shuttle unit having approximately the same weight as that of said print shuttle unit and disposed so that the center of gravity of said balance shuttle unit travels on a line approximately the same as a line of travel of the center of gravity of said print shuttle unit; and means for driving said balance shuttle unit to reciprocate in linked relation to the reciprocating motion of said print shuttle unit in parallel but reverse in direction to said print shuttle unit;

wherein said balance shuttle unit has a balance shuttle driven by said driving means in a direction opposite to a direction of travel of said print shuttle unit, and a counterweight unit connected to said balance shuttle by connecting means and disposed at a position which faces said balance shuttle across said print shuttle unit.

26. A shuttle apparatus for a printer according to claim 25, and further comprising a base frame for supporting both said print shuttle unit and balance shuttle unit.

27. A shuttle apparatus for a printer according to claim 26, and further comprising torque generating means connected to said base frame at a position of an axis of rotation moment induced by the motions of said print shuttle unit and balance shuttle unit to generate torque approximately equal in magnitude but opposite in direction to said rotation moment.

28. A shuttle apparatus for a printer according to claim 26, and further comprising a counterweight exerting moment of inertia equivalent to or larger than rotation moment induced by the reciprocating motions of said print shuttle unit and balance shuttle unit, said counterweight being attached to said base frame at a position of an axis of said rotation moment.

29. A shuttle apparatus for a printer according to claim 26, further comprising a basing enclosing said frame with said print shuttle unit and said balance shuttle unit, and a vibration absorbing member interposed between said base frame and said casing.

30. A shuttle apparatus for a printer having a print shuttle unit provided with a print head and driven to perform reciprocating motion, said shuttle apparatus comprising:

a balance shuttle unit having approximately the same weight as that of said print shuttle unit and disposed so that the center of gravity of said balance shuttle unit travels on a line approximately the same as a line of travel of the center of gravity of said print shuttle unit; and means for driving said balance shuttle unit to reciprocate in linked relation to the reciprocating motion of said print shuttle unit in parallel but reverse in direction to said print shuttle unit, wherein said balance shuttle unit comprises a plurality of balance shuttle units disposed with said print shuttle unit interposed therebetween so as to be driven by said driving means in a direction opposite to a direction of travel of said print shuttle unit.

31. A shuttle apparatus for a printer according to claim 30, and further comprising a base frame for supporting both said print shuttle unit and balance shuttle unit.

32. A shuttle apparatus for a printer according to claim 31, and further comprising torque generating means connected to said base frame at a position of an axis of rotation moment induced by the motions of said print shuttle unit and balance shuttle unit to generate torque approximately equal in magnitude but opposite in direction to said rotation moment.

33. A shuttle apparatus for a printer according to claim 1, and further comprising a counterweight exerting moment of inertia equivalent to or larger than rotation moment induced by the reciprocating motions of said print shuttle unit and balance shuttle unit, said counterweight being attached to said base frame at a position of an axis of said rotation moment.

34. A shuttle apparatus for a printer according to claim 31, further comprising a casing enclosing said frame with said print shuttle unit and said balance shuttle unit, and a vibration adsorbing member interposed between said base frame and said casing.

* * * * *